US005157807A

United States Patent [19]

Keller et al.

[11] Patent Number: 5,157,807

[45] Date of Patent: Oct. 27, 1992

[54] VIBRATION-CUSHIONED HANDLE

[75] Inventors: Michael Keller, Nürtingen; Uwe Bunz, Wolfschlugen, both of Fed. Rep. of Germany

[73] Assignee: Metabowerke GmbH & Co., Nurtingen, Fed. Rep. of Germany

[21] Appl. No.: 679,729

[22] Filed: Apr. 3, 1991

[30] Foreign Application Priority Data

Apr. 6, 1990 [DE] Fed. Rep. of Germany ..... 4011124

[51] Int. Cl.[5] ..... B25G 1/00; B25D 17/04

[52] U.S. Cl. ..... 16/116 R; 173/162.2

[58] Field of Search ..... 16/116 R, 111 R; 173/162.2

[56] References Cited

U.S. PATENT DOCUMENTS 4,936,394 6/1990 Ohtsu ..... 173/162.2

FOREIGN PATENT DOCUMENTS 2804223 8/1979 Fed. Rep. of Germany .... 16/116 R 3124349 7/1982 Fed. Rep. of Germany .

2138348 10/1984 United Kingdom ..... 173/162.2g37

*Primary Examiner*—John Sipos

*Assistant Examiner*—Carmine Cuda

*Attorney, Agent, or Firm*—Charles E. Baxley

[57] ABSTRACT

A vibration-cushioned handle, to be clamped in at one end, is designed for an electrical tool or the like. The handle has a coupling at one end for firm attachment to the body of the tool, and a coaxial handle sleeve. At least one cushioned spring element is located between the sleeve and the coupling. The handle provides good reduction of vibration, and sufficient sturdiness of the handle connection on the other, while being of simple construction. To this purpose, the spring element has different spring rigidities, on the one side in the radial direction relative to the axis of the handle sleeve, and on the other side in the direction of a pendulous or Cardanic excursion of the handle sleeve, around a pole lying on their axis.

16 Claims, 3 Drawing Sheets

VIBRATION-CUSHIONED HANDLE

BACKGROUND OF THE INVENTION

This invention relates to a vibration-cushioned handle, and more particularly to such a handle of the known type having a coupling for attachment to the housing of a tool, a handle sleeve coaxial with the coupling and a cushioned spring element between the sleeve and the coupling.

A handle is known from Kieser et. al. DE 28 04 223 C2, in which rubbery-elastic intermediate pieces in the shape of sleeves are located between a mandrel connected coaxially to the coupling and the handle sleeve of the handle, which should be formed in such a way that in particular jolts and vibrations that occur vertically to the axis of the body of the handle are cushioned on transfer to the body of the handle and the handle sleeve. The type of vibratory system and the subsequent spring characteristic of the rubbery-elastic intermediate pieces is not discussed in DE 28 04 223 C2.

In DE 31 24 349 Al there is a description of a handle with vibration cushioning, which has a front vibratory mass body at the handle sleeve close to the coupling, and an end-side vibratory mass body at the free end of the handle sleeve, both of which are hung to the coupling via elastic connector elements. With this arrangement, the end-side vibratory mass body is connected with the coupling via a first, more rigid connector element, and with the front vibratory mass body via a second, less rigid connector element. In this way, the end-side vibratory mass body is intended to vibrate opposite the front vibratory mass body as a cantilever. The handle sleeve itself serves here as a spring element, which is hinged to the front vibratory mass body, which is connected to the coupling by elastic components, the spring rigidity of which is not described in more detail. The principle of a coupled vibrator is used in this known handle, however, but three spring elements and two additional vibration mass bodies must be adjusted to each other, which is hardly usable in practice.

An important object of the invention is therefore to solve the task of providing a vibration-cushioned handle of the known type described above, which, while having a simple construction, offers good vibration reduction on the one hand, and sufficient sturdiness of the handle coupling on the other.

SUMMARY OF THE INVENTION

This task is solved with a vibration-cushioned handle of the known type described above by providing the spring element with a different spring rigidity on one side in the radial direction relative to the axis of the handle sleeve, compared with the other side in the direction of a pendulous or Cardanic excursion of the handle sleeve around a pole lying on their axis.

The particular advantage of a vibration-cushioned handle conforming to the invention lies in the fact that the handle sleeve is joined to the coupling by way of a system of springs, in which two springs, which may also be unified in a single spring element, as a result of their different spring rigidities, form a coupled vibrator with two resonance frequencies, between which there is a frequency range in which optimum cushioning takes place. The width of this frequency range, i.e. the cushioning and insulation area, should on the basis of experience, be designed to capture an additional three to five upper frequencies with a significant amplitude for the vibration load, as well as the base excitation frequency. Depending on the respective excitation frequency, the handle mass and the cushioning factors, and taking into account the assessment of hand-arm vibrations with hand tools, the various rigidities of the two springs must be selected for the individual case of application, in order to achieve ideal insulation of vibration.

When stating the radial direction of excursion, in which the radial spring rigidity of the spring system is effective, the direction that is referred to is that in which an axial parallel displacement takes place between the coupling and the handle sleeve. The pendulous or Cardanic direction of excursion, in which the Cardanic spring rigidity of the spring system takes effect, relates to the movement made by the handle sleeve relative to a pole on its axis. The actual occurring vibrations consist of superimposed vibrations of different direction, the main parts of which are distributed in the two directions described above.

It is of additional benefit if the spring rigidity of the spring system is greater in the radial direction than in the pendulous or Cardanic direction of excursion. It is also practical if the spring system in the Cardanic direction of excursion has a spring characteristic with a resonance frequency that is lower than the base or excitation frequency transferred from the coupling, whereby the spring system in the radial direction of excursion has a spring characteristic with a resonance frequency that is at least two times higher than that in the Cardanic direction of excursion. With conventional vibratory electrical hand tools or pneumatic hand tools, such as hammer drills or angle grinders, the lower resonance frequency for the spring system in the Cardanic direction of excursion should lie below the base or excitation frequency by a factor of at least 1:4.

In order to achieve the different spring rigidity in the radial direction of excursion on the one hand, and in the Cardanic direction of excursion on the other, one can either design the spring system with one or several spring components of the same or differing spring rigidity arranged one behind the other in the radial direction, or with two-part spring components which are arranged separated from each other in the axial direction. In the latter case, it is beneficial to put a first-part spring close to the clamping point, and a second-part spring close to the free end of the handle sleeve, with the first-part spring having a lower spring rigidity than the second-part spring. In this way, one obtains a higher resulting spring rigidity in the radial direction of excursion, since in this direction, the spring characteristics of both part springs are added. In the Cardanic direction of excursion, however, the spring characteristic is low due to the weaker spring rigidity of the first-part spring.

An enhanced design uses spring elements made of rubber or rubbery-elastic material, in order that the spring and cushioning characteristics respectively, can be unified in a single element. The rigidity and the cushioning properties can be varied widely by a rubber spring, and can be influenced both by the geometrical shape, as well as the properties of the rubber, particularly hardness, thus permitting easy adaptation to the various cases of application.

Further advantageous design features of the invention are brought out hereinafter.

DESCRIPTION OF THE DRAWING

The invention is described below with reference to the accompanying views in which.

DESCRIPTION OF THE INVENTION

Figure 1:
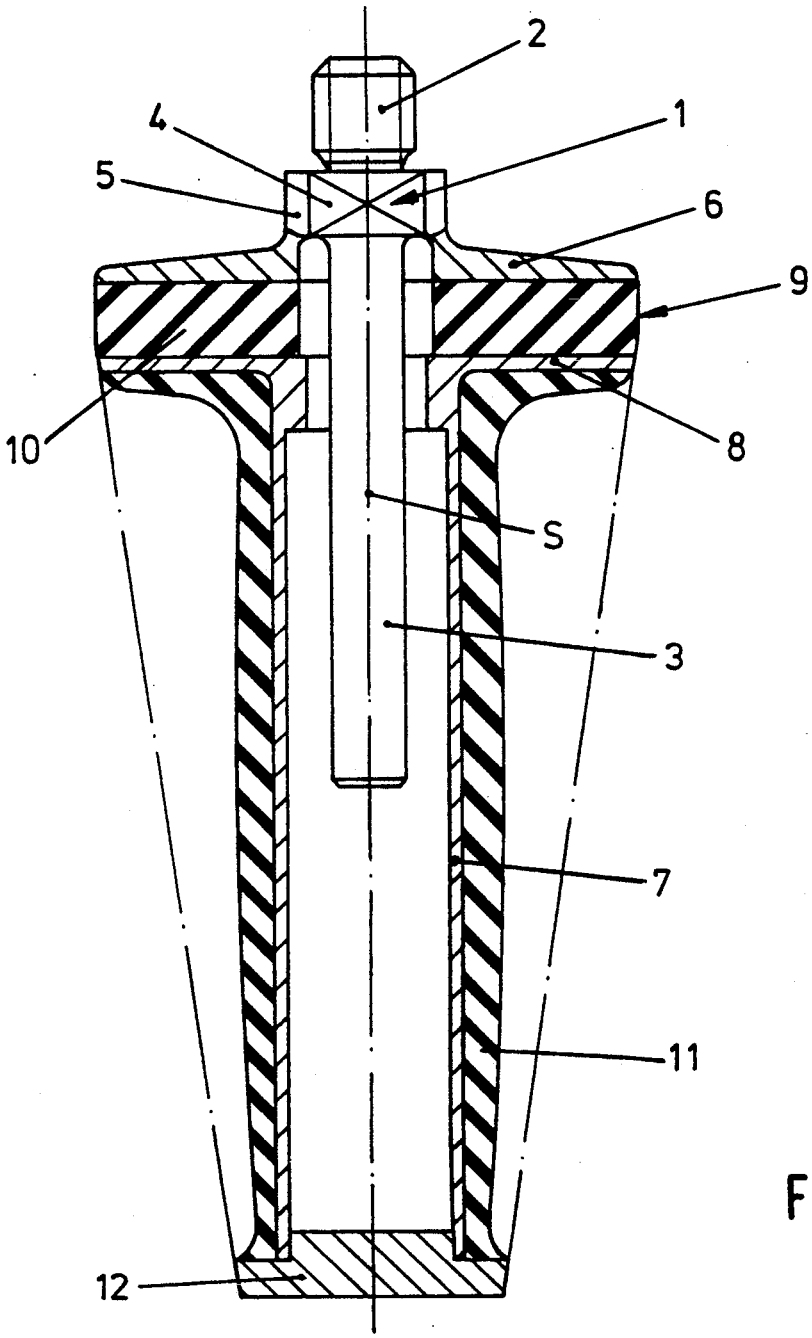
FIG. 1 is a longitudinal section through a handle conforming to a first design.

FIG. 1 shows a handle with a coupling 1, by which the handle may be firmly connected to the housing of an electrical hand tool or the like (not shown). The coupling 1 has a thread base 2, which can be screwed into a threaded hole in the tool housing. Coaxially to the thread base 2, the coupling has a mandrel 3. Between the mandrel 3 and the thread base 2 on the coupling 1 is located a multiedge section 4, on which a sleeve 5 is pressed. The sleeve 5 is single part with a radial flange 6, which on the side facing the thread base 2 has a plane connection surface in the radial direction.

Located coaxially to the coupling 1 is a handle sleeve 7 or a handle body, which is at least partly penetrated by the mandrel 3 of the coupling 1. The handle sleeve 7 also has a radial flange 8 at the end facing the clamping point, which lies coaxially opposite at a distance from the radial flange 6 of the coupling, and has a plane radial connection surface. Both radial flanges 6 and 8 also have the same diameter, and accommodate a spring element 9 between them.

The spring element 9 has, in the example shown in FIG. 1, the form of a spring washer 10, which is made of rubber material and is joined firmly to the connection surfaces of the radial flanges 6 and 8 of the coupling 1 and the handle sleeve 7 by vulcanizing. Consequently, the spring washer 10 can also transfer thrust forces which are directed in from the radial flanges 6 and 8, parallel to the respective connection surfaces. In the effective direction of these forces, i.e. in the radial direction to the coupling 1 and the handle sleeve 7, the spring washer 10 has a different, higher rigidity than in the Cardanic direction. The spring washer 10 thus unifies two springs in itself, with one spring acting in the radial direction and the other in the axial direction. The spring washer 10 is acted on primarily by vibratory components of the coupling 1 lying vertical to the axial direction, whereby the spring washer is displaced, compressed or stretched. The weaker Cardanic spring rigidity results from the compression and stretching of the spring washer 10 on two diametrically opposing points. As a result, the handle sleeve 7 performs Cardanic movements against the coupling 1, making pendulous movements around a pole S lying on their axis.

Due to the differing spring characteristics of the spring washer 10, and thus also the spring element 9, the handle sleeve 7 is connected to the coupling 1 in the style of a cushioned, coupled vibrator, whereby the resonance frequency of the spring washer 10 in the direction of Cardanic spring rigidity is selected at a factor of around 1:4 below the excitation base frequency of the coupling 1, and the resonance frequency of radial spring rigidity of the spring washer above the disturbing upper vibrations of the base frequency. It is practical to have the upper resonance frequency at least twice the lower resonance frequency. Between these two resonance frequencies there is a frequency range in which the handle sleeve 7 experiences optimum vibration cushioning against the coupling 1.

The cushioning of vibration can be enhanced by a coating 1 on the handle sleeve 7, made of rubber or a rubbery-elastic material. The handle coating 11 should be ergonomically-shaped so as to be comfortably held by a human hand, and its rubbery-elastic material offers on one hand good cushioning in the resonance range of the vibratory system, and guarantees on the other hand the greatest possible insulation from vibration. To accommodate all demands made of it, one should select the handle coating 11 with Shore hardness ratings of 40 to 75 Shore A, in order that the haptic properties are also enhanced. If the coating is thick enough, this relatively soft material can offer compensation and adaptation to the anatomically different hand sizes of persons operating the equipment, and above all, a handle coating of this type also insulates the unpleasant high frequency vibrations.

The handle sleeve 7 is closed at its free end by a plug 12, which on the one hand presents an additional mass, and on the other hand, assists towards the soft handle coating 11 not being able to be damaged or destroyed at the end face side of the handle sleeve 7, particularly when the machine to which the handle is fitted is put down.

Figure 2:
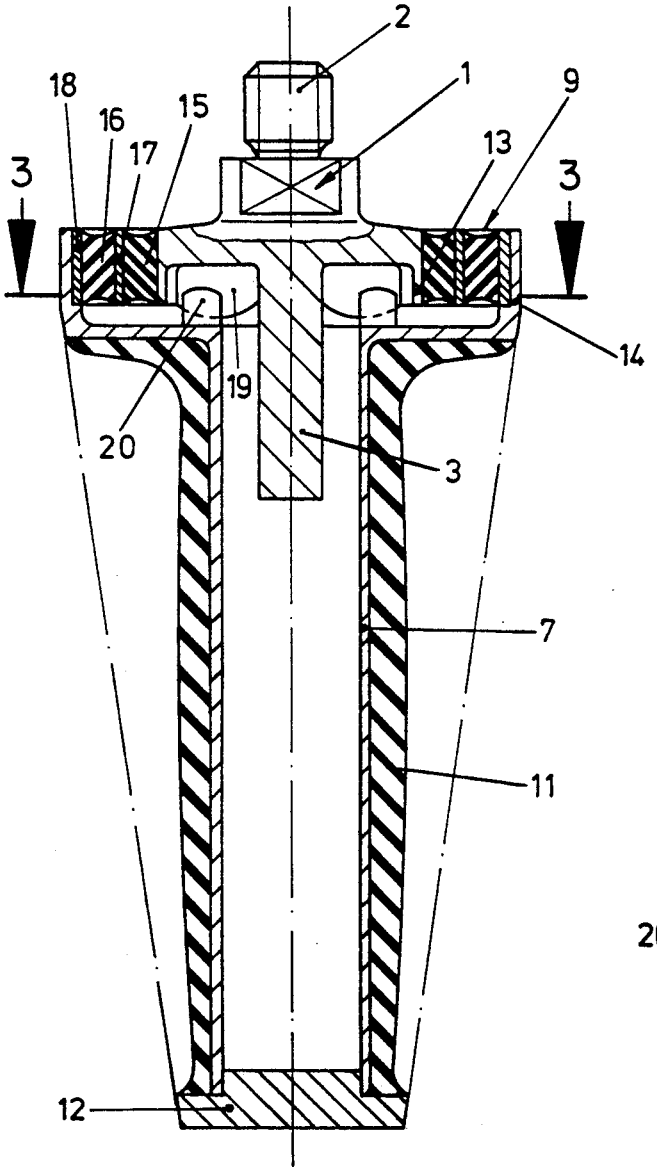
FIG. 2 is a longitudinal section through a handle conforming to a second design.

The example shown in FIG. 2 is largely differentiated from FIG. 1 in having a different form of spring element 9, which here is located between a band 13 on the coupling 1, which goes around the circumference, and a collar 14 on the handle sleeve 7 which is around this band 13 with a space therebetween. The spring element 9 consists of several spring sections 15 and 16, which lie one inside the other in a radial direction and are enclosed by coaxial intermediate sleeves 17 and 18. Collectively, this forms a rubber sleeve spring 15–18, with which, in comparison with the rubber spring according to the example in FIG. 1, and with the same geometric dimensions, lower Cardanic spring rigidities and higher radial (thrust) rigidities can be implemented. Here, particularly, the radial spring rigidity can be increased further with the existing geometric conditions by using one or more intermediate sleeves 17 and 18 and appropriate sectioning of the rubber sleeve springs in spring sections 15 and 16, without any noticeable influence on the Cardanic spring rigidity.

With this version also, the handle behaves as a coupled vibrator, since it has an identical degree of freedom as in FIG. 1, and both main vibrations, namely those in the radial and the Cardanic direction of excursion, are coupled with each other.

Figure 3:
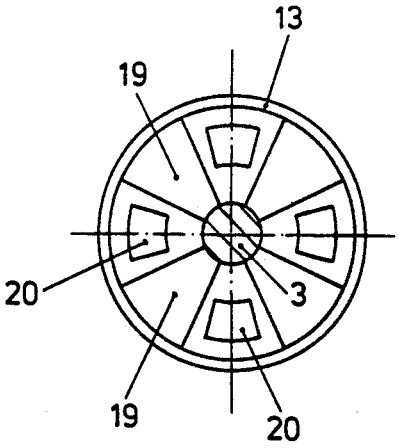
FIG. 3 is a central cross-section or line 3—3 of in FIG. 2.

To protect against impermissible torsion stress with this version, dogs 19 are fitted to the coupling, and opposing dogs 20 to the handle sleeve 7, and are engaged with play on all sides, as shown in FIG. 3, in order to prevent a positive connection which would obstruct the compensation of vibration. Only with overproportionally high radial and lateral forces will the dogs 19 and opposing dogs 20 impact with each other, but forces of this extreme ca be taken account of by mandrel 3 contacting the inner side of the handle sleeve 7.

Figure 4:
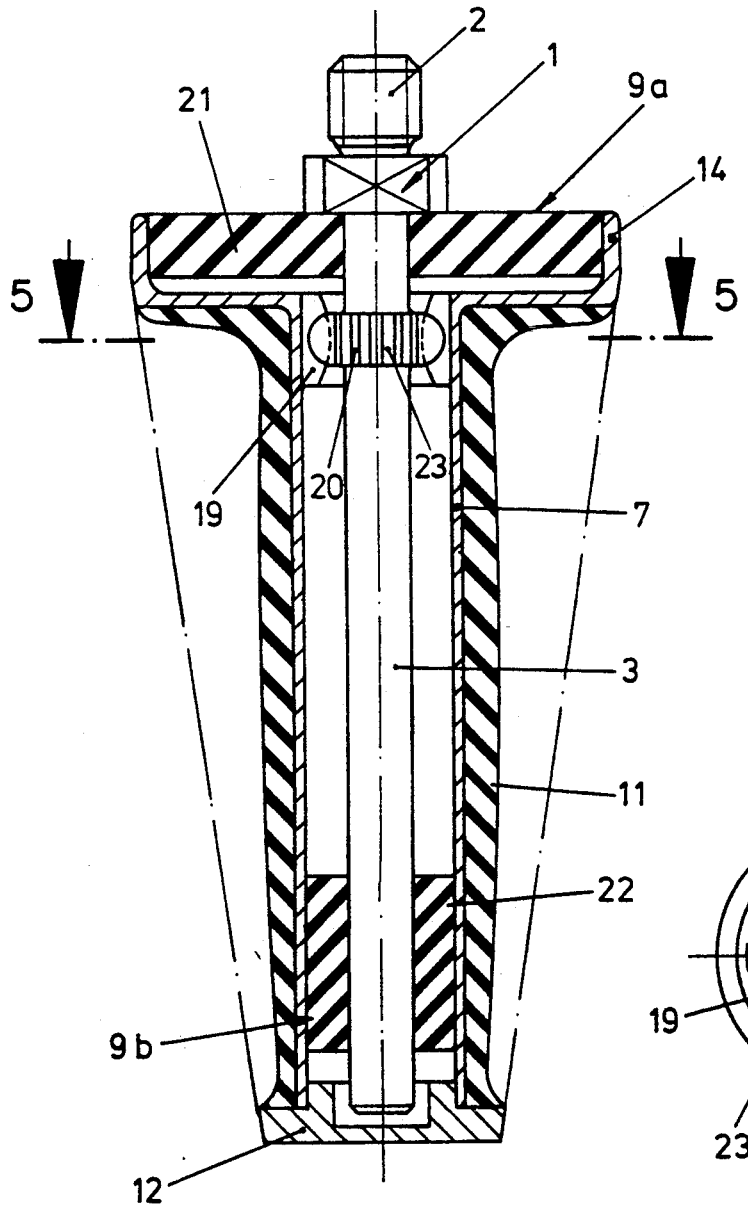
FIG. 4 is a longitudinal section through a handle conforming to a third design.
Figure 5:
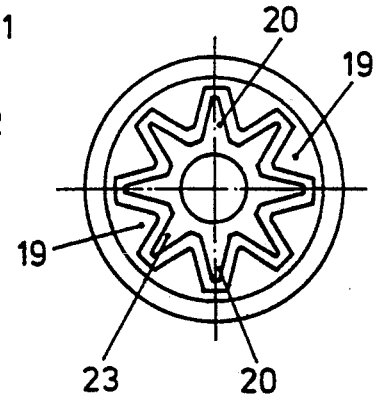
FIG. 5 is a cross-section or line 5—5 of FIG. 4.

The examples in FIG. 4 and FIG. 5 show another version of the dogs 19 and opposing dogs 20, whereby the dogs 20 here are arranged on a radially protruding band 23, somewhat in the shape of a cog, located on the mandrel 3 of the coupling 1.

The example in FIG. 4 shows a further design of the spring element 9, which here is divided into one part spring 9*a* located close to the clamping point, and a second part spring 9*b* located close to the free end of the handle sleeve 7. The first part spring 9*a* is formed by a rubber sleeve spring 21, the radial height of which is greater than the axial width, which achieves a lower radial spring rigidity than that of the second spring element 9*b*. The second spring element 9*b* is also a rubber sleeve spring 22, the radial height of which, however, is smaller than the axial width, resulting in the relatively high radial spring rigidity. The two rubber sleeve springs 21 and 22 are located directly on the mandrel 3 of the coupling 1 on the one side, and support themselves on the other side directly on the handle sleeve 7, which in this example has a collar with a wider diameter towards the clamping point, in order to accommodate the rubber sleeve spring 21, which is higher in the radial direction, close to the clamping point.

What is claimed is:

1. A vibration-cushioned handle to be clamped at one end, for a hand tool, with a coupling which can be firmly attached to the housing of the tool, and a handle sleeve coaxial with the coupling with at least one cushioned spring element located between the sleeve and the coupling, characterized in that the spring element (9) has a different spring rigidity on one side in the radial direction relative to the axis of the handle sleeve (7), compared with the other side in the direction of a pendulous or Cardanic excursion of the handle sleeve (7), around a pole (S) lying on their axis, characterized further in that the spring rigidity of the spring element (9) is higher in the radial direction than in the direction of pendulous or Cardanic excursion, and characterized still further in that the spring element (9) has, in the direction of Cardanic excursion, a spring characteristic with a resonance frequency which is lower than the excitation frequency transferred from the coupling (1).

2. A handle according to claim 1, characterized in that the spring element (9) has, in the direction of radial excursion, a spring characteristic with a resonance frequency which is at least two times as high as in the direction of Cardanic excursion.

3. A handle according to claim 1, characterized in that the spring element (9) consists of two or more spring members (15, 16) of the same or differing spring rigidity, located one behind the other in the radial direction.

4. A handle according to claim 1, characterized in that the spring element (9) is located near the clamping point.

5. A handle according to claim 1, characterized in that the spring element (9) consists of two-part springs (9*a*, 9*b*) which are located separately from each other in the axial direction of the handle sleeve (7).

6. A handle according to claim 5, characterized in that the first-part spring (9*a*) is located near to the clamping point, and the second-part spring close to the free end of the handle sleeve (7).

7. A handle according to claim 6, characterized in that the first-part spring (9*a*) has a lower radial spring rigidity, and the second-part spring (9*b*) a higher radial spring rigidity.

8. A handle according to claim 1, characterized in that the spring element (9) is made of rubber or a rubbery-elastic material.

9. A handle according to claim 8, characterized in that coaxially opposing radial flanges (6, 8) are located on the coupling (1) and on the inner end of the handle sleeve, between which a spring washer (10) made of rubber material has been vulcanized.

10. A handle according to claim 8, characterized in that a band (13) is located on the coupling (1) in the direction of the circumference, and the handle sleeve (7) has a collar (14) with space around the band (13), with a spring rubber sleeve (15–18) being located between the band (13) and the collar (14).

11. A handle according to claim 10, characterized in that the rubber sleeve spring (15–18) is subdivided in the radial direction into two or more spring sections (15, 16) by one or more coaxial intermediate sleeves (17, 18).

12. A handle according to claim 8, characterized in that the coupling (1) has a mandrel (3) extending coaxially through the handle sleeve (7), whereby the handle sleeve (7) through the collar (14) has a widened diameter at the end facing the clamping point, and that between the collar (14) of the handle sleeve (7) and the mandrel (3), an initial rubber sleeve spring (21) is located, the radial height of which is greater than the radial width, and that a second rubber sleeve spring (22) is located close to the free end between the handle sleeve (7) and the mandrel (3), the radial height of which is smaller than the radial width.

13. A handle according to claim 1, characterized in that an additional mass (12) is located at the free end of the handle sleeve (7).

14. A handle according to claim 13, characterized in that the additional mass (12) is formed by a closure plug in the handle sleeve (7).

15. A handle according to claim 1, characterized in that the handle sleeve has a coating (11) made of a rubbery elastic material.

16. A handle according to claim 1, characterized in that dogs (19) and dogs (20) are mounted respectively on the coupling (1) and the handle sleeve (7) as antitwist elements, and alternate circumferentially with each other with circumferential play therebetween.

* * * * *